US009076321B2

(12) United States Patent
Farley

(10) Patent No.: US 9,076,321 B2
(45) Date of Patent: Jul. 7, 2015

(54) REAL TIME CONTROL CHART GENERATION AND MONITORING OF SAFETY SYSTEMS

(71) Applicant: SimplexGrinnell LP, Westminster, MA (US)

(72) Inventor: Daniel G. Farley, Westminster, MA (US)

(73) Assignee: TYCO FIRE & SECURITY GMBH, Neuhausen am Rheinfall (CH)

( * ) Notice: Subject to any disclaimer, the term of this patent is extended or adjusted under 35 U.S.C. 154(b) by 253 days.

(21) Appl. No.: 13/835,525

(22) Filed: Mar. 15, 2013

(65) Prior Publication Data

US 2014/0266672 A1 Sep. 18, 2014

(51) Int. Cl.

| | |
|---|---|
| ***G08B 29/00*** | (2006.01) |
| ***G08B 29/18*** | (2006.01) |
| *G08B 29/26* | (2006.01) |

(52) U.S. Cl.

CPC ..... *G08B 29/185* (2013.01); *G08B 29/26* (2013.01)

(58) Field of Classification Search

CPC ..... H04W 12/00; G08B 17/00; G08B 19/00; G08B 29/00

USPC ..... 340/506, 507, 511, 514, 628, 632, 660

See application file for complete search history.

(56) References Cited

U.S. PATENT DOCUMENTS

| | | | | |
|---|---|---|---|---|
| 4,518,952 | A * | 5/1985 | Tanaka et al. | 340/514 |
| 4,962,368 | A * | 10/1990 | Dobrzanski et al. | 340/514 |
| 5,155,468 | A * | 10/1992 | Stanley et al. | 340/501 |
| 5,864,286 | A * | 1/1999 | Right et al. | 340/501 |
| 6,888,453 | B2 * | 5/2005 | Lutz et al. | 340/506 |
| 2002/0024436 | A1 * | 2/2002 | Suzuki et al. | 340/506 |

* cited by examiner

*Primary Examiner* — Phung Nguyen

(74) *Attorney, Agent, or Firm* — Kacvinsky Daisak Bluni PLLC

(57) ABSTRACT

A safety system may include a monitoring device that receives analog values of various parameters from one or more safety appliances. The analog values may be compared to upper and lower control limits in control charts for the parameters for each safety appliance. When an analog value falls outside of the upper control limit or lower control limit in the control chart, an alert may be issued to indicate that the safety appliance may be degrading or failing. The monitoring device may also generate control charts for safety appliances from the analog values output from the safety appliances.

18 Claims, 7 Drawing Sheets

REAL TIME CONTROL CHART GENERATION AND MONITORING OF SAFETY SYSTEMS

BACKGROUND OF THE INVENTION

1. Field of the Invention

The disclosure relates generally to the field of safety and alarm systems and more particularly to improved methods for monitoring various components within such systems.

2. Discussion of Related Art

Alarm systems, such as fire alarm systems, typically include a plurality of sensor devices that are installed throughout a monitored building which are configured to detect the presence of an alarm condition such as, for example, the presence of fire, smoke, etc. These systems also include various notification appliances (e.g. horn/strobe units) that notify occupants of the building of a potentially hazardous condition detected by one or more of the plurality of sensor devices to enable the occupants to evacuate the building or take other action before being harmed. It is therefore critically important that the sensors and notification appliances of alarm systems always be in good working order.

Governmental entities may require that notification appliances and sensor devices, particularly those of fire alarm systems, be tested and/or inspected periodically to verify that such notification appliances and sensor devices are operating properly and have not been physically compromised in some way. Such testing and inspection are typically performed by one or more designated inspectors who walk through an entire monitored building and physically visit each and every notification appliance and sensor device installed therein. The inspectors may visually inspect each notification appliance and sensor device, may activate each notification appliance and sensor device for a predetermined amount of time to verify functionality and may record the results. A drawback with current testing of notification appliances and sensor devices within alarm systems includes the inability to predict failure of such safety appliances before a catastrophic event. For example, an individual safety appliance may pass an inspection and/or a self-test, for example, by remaining within certain prescribed operating tolerances, and yet still be in the process of degrading in some way. The safety appliance may later fail and may need to be repaired or replaced. In some cases, the repair or replacement may be avoidable or less costly, if it were known earlier that the safety appliance was degrading and/or beginning to fail.

SUMMARY

In view of the foregoing, embodiments of the present disclosure are directed to systems and methods for generating control charts for use in monitoring safety systems to predict failure of the various safety appliances used within a system.

In one embodiment, a computing system monitors various analog values generated or consumed by safety appliances in a safety system, such as, for example, smoke, fire, or carbon monoxide detection appliances. The analog values may be used for several purposes. For example, the analog values may be compared to alarm thresholds for alarm decisions. The analog values may be used in conjunction with the data in a control chart for a specific safety appliance to evaluate the health of the specific appliance, and when the analog value begins to drift outside of a control chart limit, an alert may be raised.

In another embodiment, the control charts may be generated from historical data or from data gathered over a time interval. Deviations from the normal described by a control chart for a safety appliance may be used to update a control chart, if the deviation is understood and acceptable to a human operator.

DESCRIPTION OF EMBODIMENTS

Figure 1A:
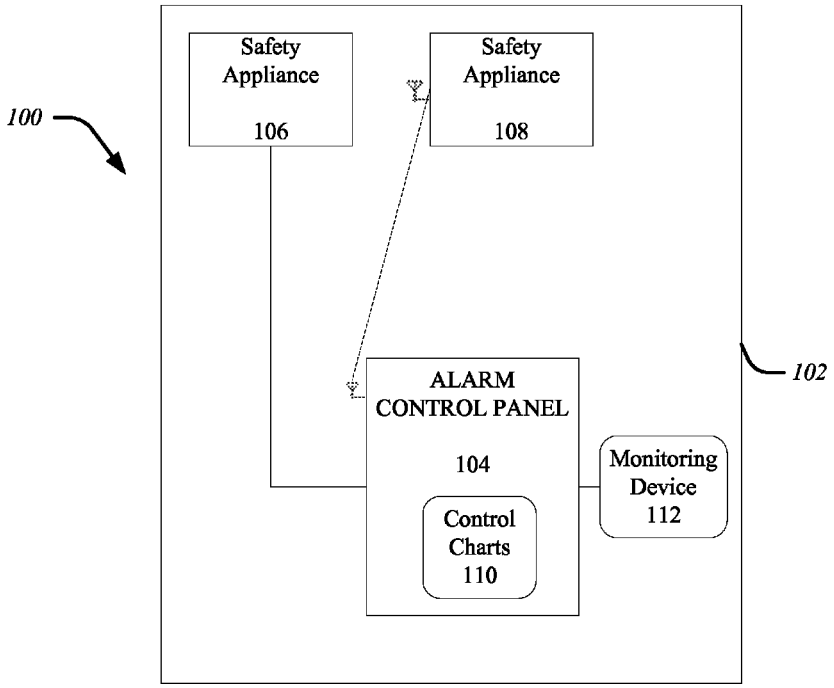
FIG. 1A is a schematic depiction of an exemplary safety system.

The present invention will now be described more fully hereinafter with reference to the accompanying drawings, in which preferred embodiments of the invention are shown. This invention, however, may be embodied in many different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout.

To solve the deficiencies associated with the methods noted above, novel and inventive techniques for managing communications, and in particular, monitoring of safety appliance performance is disclosed. In various embodiments, a safety system includes a monitoring device that is coupled to or in communication with an alarm control panel and/or with various safety appliances, including sensor devices and notification appliances. The monitoring device receives analog values from the safety appliances and compares the analog values to control charts for each safety appliance. Deviations in the analog values from normal or from upper/lower control limits in the control charts may indicate that a safety appliance is in the process of degrading in some way, and an alert may be issued to allow an operator to take corrective action. In various embodiments, the monitoring device may generate the control charts as well.

With general reference to notations and nomenclature used herein, the detailed descriptions which follow may be presented in terms of program procedures executed on a computer or network of computers. These procedural descriptions and representations are used by those skilled in the art to most effectively convey the substance of their work to others skilled in the art.

A procedure is here, and generally, conceived to be a self-consistent sequence of operations leading to a desired result. These operations are those requiring physical manipulations of physical quantities. Usually, though not necessarily, these quantities take the form of electrical, magnetic or optical signals capable of being stored, transferred, combined, compared, and otherwise manipulated. It proves convenient at times, principally for reasons of common usage, to refer to these signals as bits, values, elements, symbols, characters, terms, numbers, or the like. It should be noted, however, that all of these and similar terms are to be associated with the appropriate physical quantities and are merely convenient labels applied to those quantities.

Further, the manipulations performed are often referred to in terms, such as adding or comparing, which are commonly associated with mental operations performed by a human operator. No such capability of a human operator is necessary, or desirable in most cases, in any of the operations described herein which form part of one or more embodiments. Rather, the operations are machine operations. Useful machines for performing operations of various embodiments include general purpose digital computers or similar devices.

FIG. 1A illustrates one embodiment of a safety system 100. As illustrated, safety system 100 is situated in a structure 102, which may be a multistory building. The safety system 100 includes various components that may be deployed at different locations within structure 102. As illustrated, safety system 100 includes an alarm control panel (ACP) 104, which may be located in a lower story of a multistory building in some embodiments. As further illustrated in FIG. 1A, safety system 100 may include a wired safety appliance 106 that is linked to ACP 104 through a hardwire connection. The terms "hardwire" and "wired" are used herein interchangeably, refer in reference to circuits to a type of circuit or connection between multiple components that connects one or more components via a physical wire(s), fiber(s), or other physical structures that conducts electrical or electromagnetic signals or both, between the different components. Safety system 100 may further include a wireless safety appliance 108 that is linked to ACP 104 through a wireless connection, for example, via radio waves, cellular telephone signals, WI-FI signals, infrared signals, and the like.

Safety system 100 may include any number of wired safety appliances 106 and wireless safety appliances 108. As used herein, the term "safety appliance," absent a numeric reference, refers to both wired safety appliances 106 and wireless safety appliances 108. A safety appliance may include sensor devices that monitor some condition in a physical location, as well as notification devices that notify people in the vicinity of the notification appliance of a condition. Examples of safety appliances may include, without limitation, a smoke detector, a heat detector, a carbon monoxide detector, a motion sensor, a sound detector, a door or window opening detector, as well as detectors for various gases or liquids, sirens, strobe lights, horns, speakers, dynamic signs, and so forth. The safety appliances may be installed in various locations throughout structure 102, such as on separate stories.

In one example, ACP 104 may perform various functions, including receiving information from the safety appliances, monitoring their operational integrity and providing for automatic control of equipment, and transmission of information necessary to prepare the facility for detected conditions based on a predetermined sequence. ACP 104 may also supply electrical energy to operate any associated sensor, control, transmitter, or relay (not shown).

Safety system 100 may further include control charts 110. Control charts 110 are collections of data specific to a particular safety appliance and to a particular parameter of a particular safety appliance. A control chart 100 may include an upper control limit and a lower control limit that provide boundaries for the given parameter. Analog values received from the safety appliance may be compared to the control limits. In one embodiment, control charts 110 may be stored with ACP 104. Control charts 110 are discussed in more detail with respect to FIG. 3.

Safety system 100 may further include a monitoring device 112. Monitoring device 112 may be a computing device that receives the analog values from the safety appliances and compares them to control charts 110 to determine whether a safety appliance's performance is degrading in some way. In an embodiment, monitoring device 112 may be co-located with the safety appliances and ACP 104 in building structure 102. In an embodiment, control charts 110 may be stored on monitoring device 112 instead of on ACP 104 (not shown). In still another embodiment, monitoring device 112 may be an internal component of ACP 104 (not shown). Monitoring device 112 is discussed further with respect to FIG. 3.

Figure 1B:
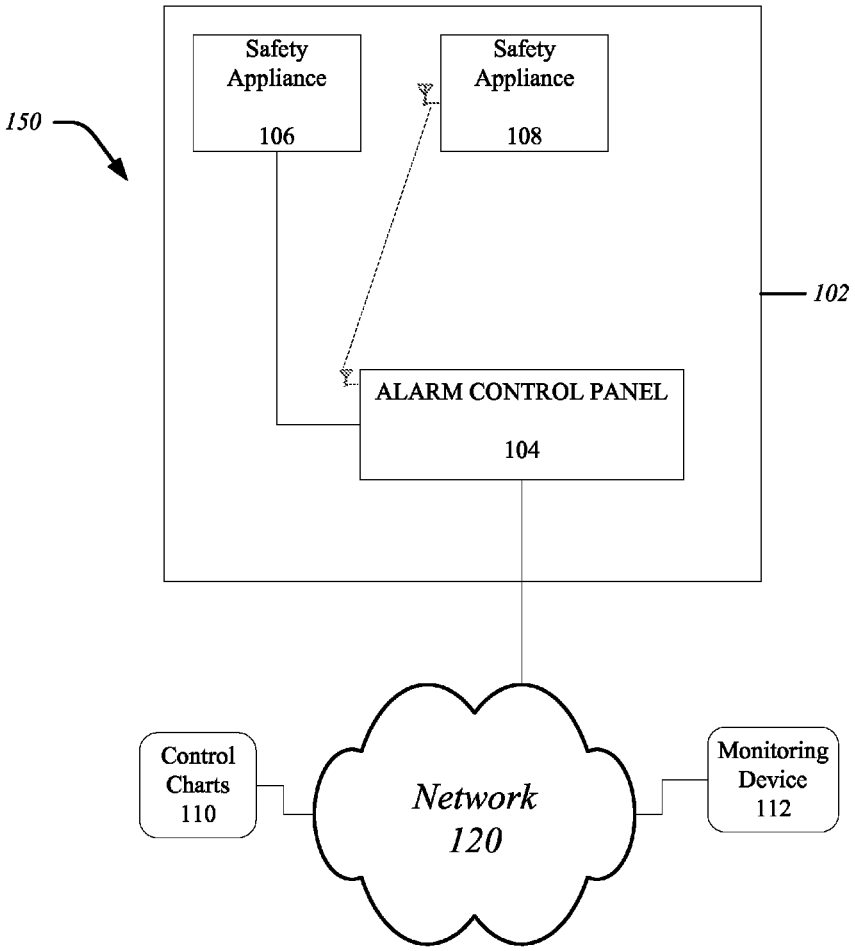
FIG. 1B is a schematic depiction of another exemplary safety system.

FIG. 1B illustrates an alternative embodiment of a safety system 150. Safety system 150 is similar to safety system 100, however, monitoring device 112 may be located remotely from ACP 104 and from building structure 102. Monitoring device 112 may be communicatively coupled to ACP 104 via a network 120.

Network 120 may include any network capable of transmitting data at least from the safety appliances to monitoring device 112 either directly, or via ACP 104. Examples of network 120 may include, without limitation, the Internet, a wireless communication network, an intranet, a cellular signal network, and so forth.

One or more control charts 110 may be stored on a computer-readable storage medium separately and remotely from both ACP 104 and monitoring device 112, for example, on a data storage server (not shown). In such an embodiment, control charts 110 may be accessible to monitoring device 112 via network 120. Alternatively, control charts 110 may be stored with monitoring device 112, for example, on a storage medium physically coupled to monitoring device 112 or housed within monitoring device 112 (also not shown). The embodiments are not limited to these examples.

Figure 2:
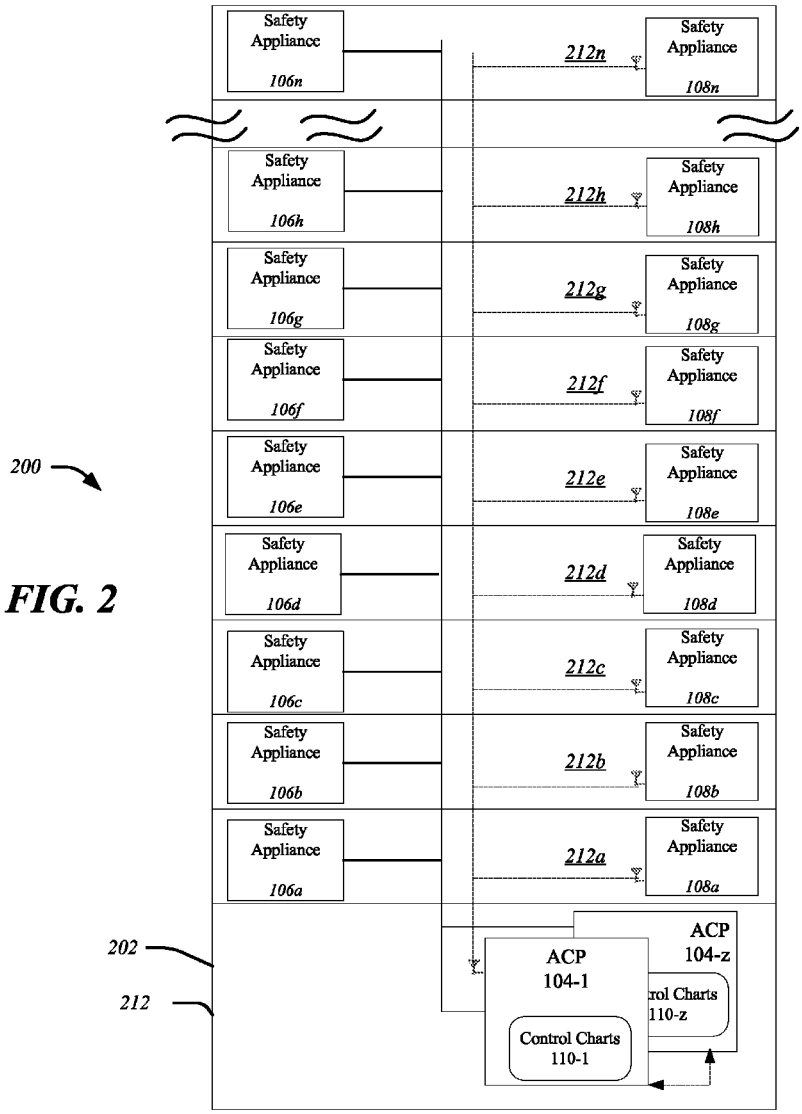
FIG. 2 is a schematic depiction of another exemplary safety system.

FIG. 2 depicts a safety system 200 according to another embodiment. In this embodiment, safety system 200 may be deployed in a building or other multistory structure 202. In the example depicted in FIG. 2, building 202 includes, in addition to a floor (story) 212, stories 212*a* to 212*n*, where "a" to "n" may represent any positive integer. Although depicted as having at least ten stories, in various embodiments building 202 may include fewer stories or many more stories. As further shown in FIG. 2, a wired safety appliance 106 and a wireless safety appliance 108 are deployed in story 212, which may be a lower story such as a ground floor or basement of the building 202. Notably, in various embodiments, one or more safety appliances, either wired safety appliance 106 or wireless safety appliance 108, or both, may be included in each story of the building 202. In other embodiments, more than one safety appliance, of either or both types, may be included in one or more of the stories 212*a* to 212*n*, while in still other embodiments, not all stories 212*a* to 212*n* need include a safety appliance.

Safety system 200 may include more than one alarm control panel (ACP) 104-1, 104-*z*, where "z" represents a positive integer. ACP 104-1 may only receive data from a subset of safety appliances, e.g. from safety appliances 106-*a* through 106-*f*, and safety appliances 108-*a* through 108-*f* ACP 104-*z* may only receive data from another subset of safety appliances, such as from safety appliances 106-*g* through 106-*n*, and safety appliances 108-*g* through 108-*n*.

Each safety appliance may have its own control chart 110 associated with it. If a particular type of safety appliance has more than one parameter that needs to be monitored, that safety appliance may have several control charts 110 associated with it, or may have a control chart that includes data for the multiple parameters. When one ACP 104 receives data from a subset of all of the safety appliances, e.g. ACP 104-1, the control charts 110-1 may be associated with only the safety appliances in that subsets.

Figure 3:
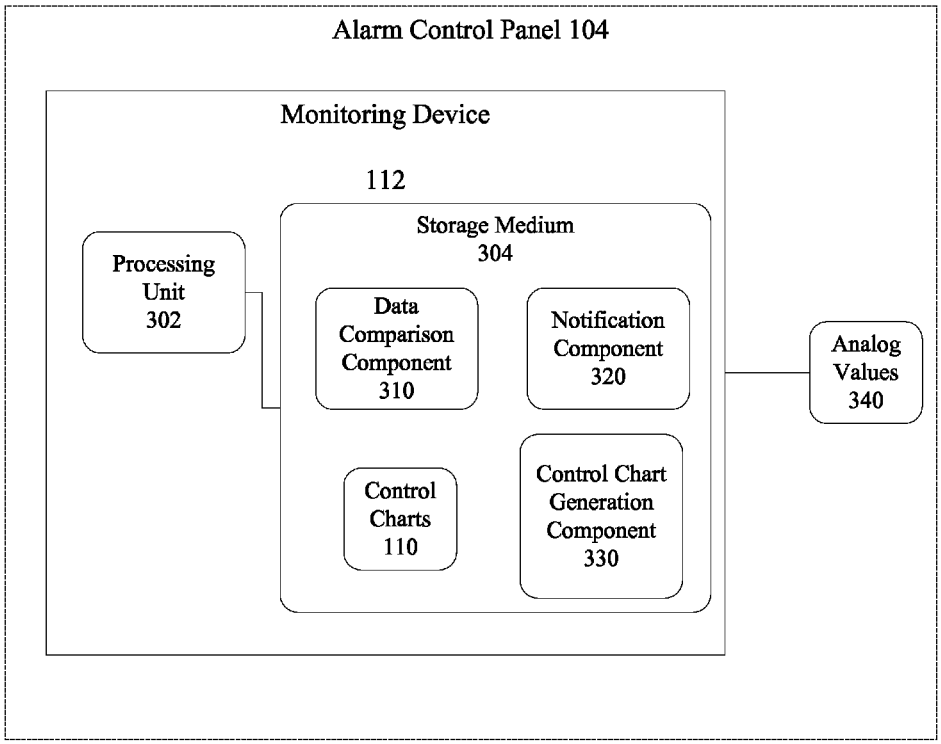
FIG. 3 is a block diagram of a monitoring device.

FIG. 3 depicts an embodiment of a monitoring device 112. Monitoring device 112 may be a component of an alarm control panel, e.g. ACP 104, or may be a separate device in communication with an alarm control panel. Monitoring device 112 may include a processing unit 302 and a computer-readable storage medium 304 communicatively coupled to processing unit 302. Processing unit 302 may be one or more logic devices capable of executing instructions, e.g. software code, to cause monitoring device 112 to perform various functions. Monitoring device 112 may include one or more functional components, such as data comparison component 310, notification component 320 and control chart generation component 330. More, fewer, or different components may be used to provide the functionality of monitoring device 112.

Computer-readable storage medium 304 may include, for example, an internal storage device such as a disk drive or a memory unit. A memory unit may include, for example, read-only memory (ROM), random-access memory (RAM), dynamic RAM (DRAM), Double-Data-Rate DRAM (DDRAM), synchronous DRAM (SDRAM), static RAM (SRAM), programmable ROM (PROM), erasable programmable ROM (EPROM), electrically erasable programmable ROM (EEPROM), flash memory, polymer memory such as ferroelectric polymer memory, ovonic memory, phase change or ferroelectric memory, silicon-oxide-nitride-oxide-silicon (SONOS) memory, magnetic or optical cards, or any other type of media suitable for storing information. As used herein, a computer-readable storage medium does not include signals or carrier waves.

Computer-readable storage medium 304 may store instructions, that when executed by processing unit 302, generate the functions of components 310, 320 and 330. Control charts 110 may be stored on computer-readable storage medium 304.

Data comparison component 310, when executing, may receive analog values 340, for example, from ACP 104 or directly from safety appliances. Analog values 340 may represent data values for one or more parameters associated with a safety appliance. Analog values 340 may also include analog values from internal safety system components, such as alarm control panel 104, that are not necessarily sensor devices or notification devices. For example, the amount of current being consumed by devices powered from a system power supply (not shown) may be an analog value 340 that is monitored. The parameters may include, without limitation, a voltage used by the safety appliance, a current drawn by the safety appliance, a temperature measured by the safety appliance, a temperature of the safety appliance, a percentage of a gas measured by the safety appliance, sounds detected by the safety appliance, motion detected by the safety appliance, or a percentage of obscurity measured by the safety appliance. If, for example, the parameter is voltage, the analog value 340 received for the voltage parameter may be three volts. In an embodiment, data comparison component 310 may passively receive analog values 340, e.g. the analog values 340 are pushed to monitoring device 112. In another embodiment, data comparison component 310 may pull the analog values 340 from ACP 104 or directly from the safety appliances.

Data comparison component 310 may compare the analog values 340 to a control chart 110 for a given parameter. In the voltage parameter example above, data comparison component 310 may refer to the control chart 110 for the safety appliance that is using three volts and compare the three volt analog value to the upper and lower control limits in the control chart 110, which could be, for example, 4 volts and 2.5 volts, respectively.

Notification component 320 may, when executing, receive information from data comparison component 310 when an analog value 340 for a safety appliance is outside of the bounds of the upper and lower control limits for the control chart of the safety appliance for a parameter. When the analog value is either larger than the upper limit or smaller than the lower limit, notification component 320 may issue an alert. Other conditions may cause notification component 320 to issue an alert. For example, when some number of consecutive analog values, e.g. 2 out of 3, are more than 2 sigma outside of the mean on the same side of the mean. That is, 2 of 3 consecutive analog values are more than 2 sigma above the mean, or 2 of 3 values are more than 2 sigma below the mean. Another alert-raising condition may include when some number of consecutive analog values, e.g. 4 out of 5, are more than 1 sigma away from average on the same side of the average. Still another alert-raising condition may include when a larger number, e.g. eight, of consecutive analog values are above or below the mean. In some cases, e.g. for certain types of safety appliance, these conditions may be considered normal drift and would not cause an alert to be issued.

Notification component 320 may issue the alert in any of various ways, including, without limitation, sending an electronic mail message to an operator, sending a text message to an operator, sending an instant message in a computer chat application, sounding an audible alarm such as a siren, producing a visible alert such as a flashing light, or generating a graphical user interface component such as a warning window on a computer or mobile device display. Notification component 320 may also be operable to dial a telephone number for an operator and either speak an alert to the operator or leave a spoken alert on a voicemail system for the operator. In generally, the condition generating such an alert is not an emergency condition, such as the detection of smoke or fire, elevated carbon monoxide levels, or that an intruder is present.

In an embodiment, notification component 320 may have internal capabilities to generate and issue an alert. In other embodiments, notification component 320 may cause other devices or software to issue an alert. For example, notification component 320 may communicate with an electronic mail application to cause the electronic mail application to send an email alert.

Control chart generation component 330 may, when executing, receive analog values 340 as described above. In some cases, a control chart 110 may not be available for a safety appliance, for example, when the safety appliance is a new model, or is newly installed in a location. Control chart generation component 330 may store the received analog values 340 in a database or other data store over time. When sufficient data is stored, control chart generation component 330 may generate a control chart 110. For example, control chart generation component 330 may calculate an upper control limit and a lower control limit, as well as an average or mean value. The generated control chart 110 may then be stored with the other existing control charts 110 for use by data comparison component 310.

Figure 4:
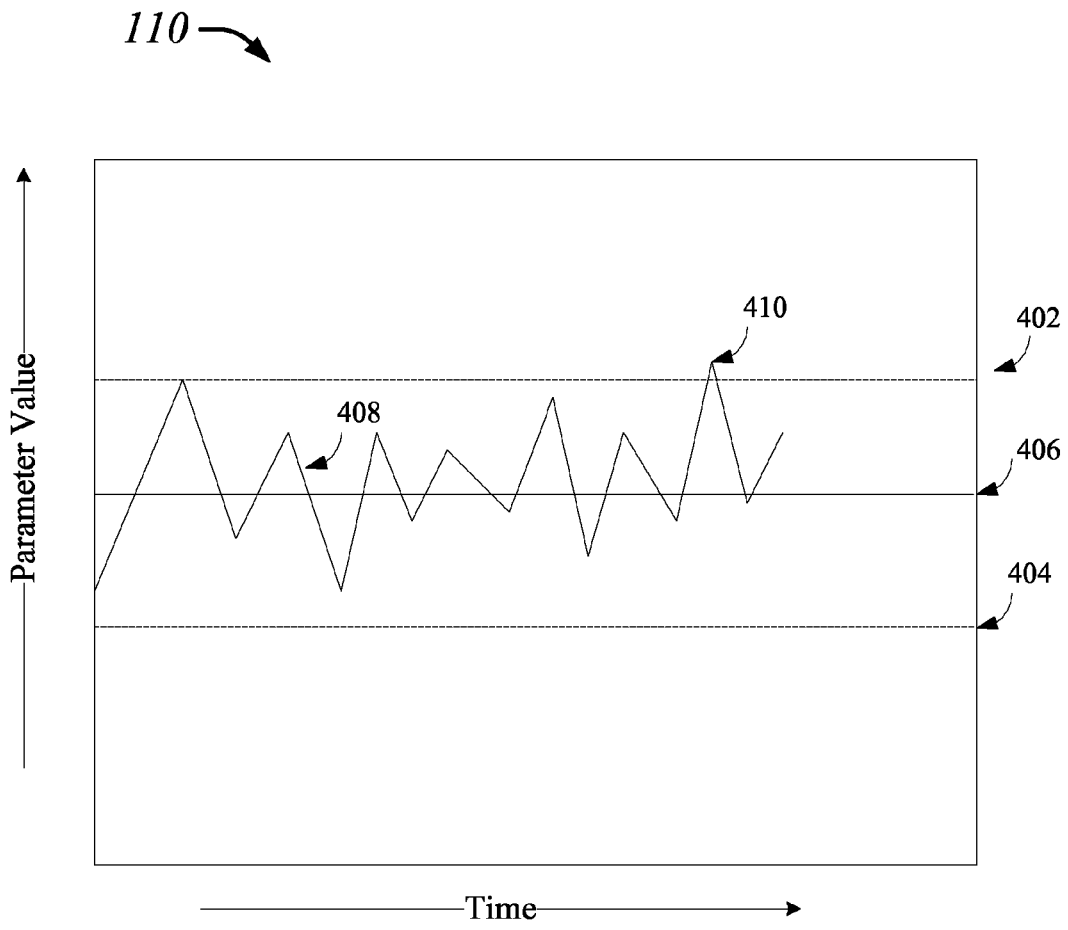
FIG. 4 depicts an example of a control chart.

FIG. 4 illustrates an example of a control chart 110. Control chart 110 may represent one or more of various operating parameters of a particular safety appliance (e.g. appliance 106 shown in FIG. 1A). Control chart 110 may be configured with time represented on an x-axis, and a parameter value on a y-axis. Once generated, control chart 110 may have an upper control limit 402 and a lower control limit 404. Control chart 110 may also include a normal, average, or mean value 406. The actual received analog values, e.g. analog values 340 shown in FIG. 3, for the parameter and safety appliance associated with control chart 110 are represented by line 408. Although depicted as a two-dimensional graph, a control chart 110 could have more than two dimensions.

As shown in FIG. 4, at point 410, an analog value for the parameter associated with control chart 110 has exceeded upper control limit 402. When this occurs, an alert may be issued. In response, an operator may be able to assess the conditions of the particular safety appliance and either take corrective action for the device, or determine that the control limit should be adjusted, e.g. raised, in this example.

Each safety appliance may have one or more parameters to be monitored. Each monitored parameter may have its own control chart 110 associated with it. Therefore, for example, one safety appliance having three monitored parameters may have three control charts associated with it, one for each parameter, so that each individual safety appliance can be monitored. In an embodiment, control chart 110 data may be represented and stored in table form, in addition to, or instead of, the graphical form shown in FIG. 4.

TABLE 1

| Appliance ID | Upper Control Limit | Lower Control Limit | Last Value | Current Value |
|---|---|---|---|---|
| SD1 | 4 volts | 2.5 volts | 3 volts | 3.2 volts |
| SD2 | 4 volts | 2.5 volts | 2.7 volts | 3.9 volts |

Table 1, as an example, represents one parameter type, e.g. voltage, and stores a row of values for each appliance. For example, the row for smoke detector 1 ("SD1") includes its upper and lower control limit values, a last value received (3 volts), and the current value (3.2 volts). In an embodiment, this allows data comparison component 310 to compare the current value to the upper and lower control limits as well as to the previous value. In some embodiments, if the change from one value to the next is larger than some threshold, an alert may be issued, even if the values are within the control limit. For example, for SD2, the parameter value increased by 1.2 volts from one measurement to the next. Even though both values are within the control limits, if such as increase is considered "large" with respect to a threshold, it may indicate a potential problem and may raise an alert. In other embodiments, no alert may be raised unless a current value exceeds the upper limit or is lower than the lower limit. In such an embodiment, the last value may not be stored. Different configurations for data storage may be used as well. For example, one table for each safety appliance may be used, where each row represents a different parameter for that safety appliance.

Figure 5:
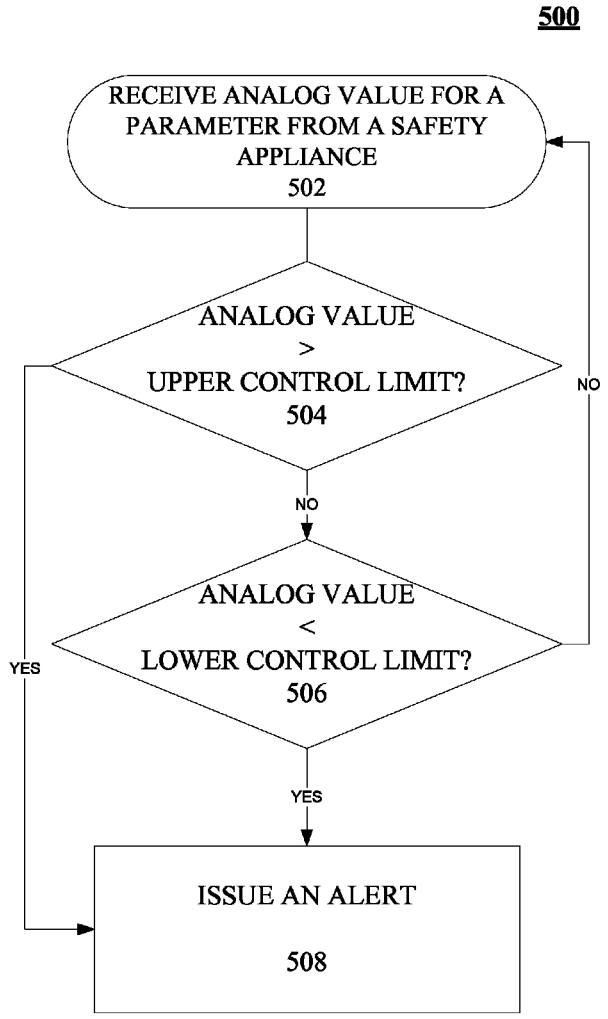
FIG. 5 depicts a logic flow in accordance with one or more embodiments.

FIG. 5 illustrates a logic flow 500 in accordance with one or more embodiments. The logic flow 500 may be performed by various systems and/or devices and may be implemented as hardware, software, and/or any combination thereof, as desired for a given set of design parameters or performance constraints. For example, the logic flow 500 may be implemented by a logic device (e.g., processor) and/or logic (e.g., threading logic) comprising instructions, data, and/or code to be executed by a logic device. In particular, logic flow 500 may be performed by monitoring device 112. For purposes of illustration, and not limitation, the logic flow 500 is described with reference to FIGS. 1A and 1B. The embodiments are not limited in this context.

Logic flow 500 may, in block 502, receive an analog value for a parameter from a safety appliance. For example, monitoring device 112 may receive an analog value 340 from wired safety appliance 106 or wireless safety appliance 108 directly, or via ACP 104.

Logic flow 500 may, in block 504, compare the analog value to the upper control limit of a control chart associated with the safety appliance and the parameter. For example, data comparison component 310 may compare the analog value 340 to the upper control limit 402 of the control chart 110.

If the analog value is larger than the upper control limit in block 504, then logic flow 500 may issue an alert at block 508. For example, notification component 320 may issue an alert as previously described. In some embodiments, an alert may be issued when a previous value for the same safety appliance and parameter differs from a current value by more than some threshold amount.

If the analog value is not larger than the upper control limit in block 504, then logic flow 500 may, in block 506, compare the analog value to the lower control limit of the control chart associated with the safety appliance and the parameter. For example, data comparison component 310 may compare the analog value 340 to the lower control limit 404 of the control chart 110.

If the analog value is less than the lower control limit in block 506, then logic flow 500 may issue an alert in block 508, as previously described. If the analog value is not less than the lower control limit in block 506, then logic flow 500 may return to block 502 to receive another analog value.

Although blocks 504 and 506 are shown in a sequential order, they may be evaluated in any order, or in parallel. Further, in some embodiments, an alert may be issued in response to other comparisons to the control chart, as described above with respect to notification component 320. Additionally, an alert may be issued, for example, only after a specified number of successive analog values fall outside of the control limits in a control chart (not shown). In the example illustrated in FIG. 4, for instance, only value 410 lies outside of the control limits, and may be an anomaly. Monitoring device 112 may wait until, for example, 5 or 10 successive analog values are outside of the control limits before issuing an alert.

In another embodiment, an alert may be issued before any one analog value falls outside of the control limits, but when a trend towards falling outside of a control limit is noticed. For example, if a series of four analog values falls toward lower control limit 404, and lower control limit 404 will be passed if the trend continues, an alert may be issued prior to the passing of the lower control limit.

In some embodiments, changing analog values may represent normal and expected drift for a type of safety appliance. The expected drift may be caused, for example, by dust accumulating at a known level, a chemical cell drying out at an expected rate, or seasonal effects. In these embodiments, the received analog values and the control charts may be adjusted to compensate for the expected drift to avoid issuing alerts for known conditions.

In addition to issuing an alert as described, some embodiments may provide a visual representation of a control chart, e.g. as in FIG. 4, in a graphical display on a computing or mobile device. An operator viewing the graphical display may use the graphical display to determine whether an analog value for a parameter has drifted outside of the control limits. In an embodiment, the graphical display may be provided on monitoring device 112 or may be remotely accessed from a second device, e.g. via a web interface, or as an email attachment.

Figure 6:
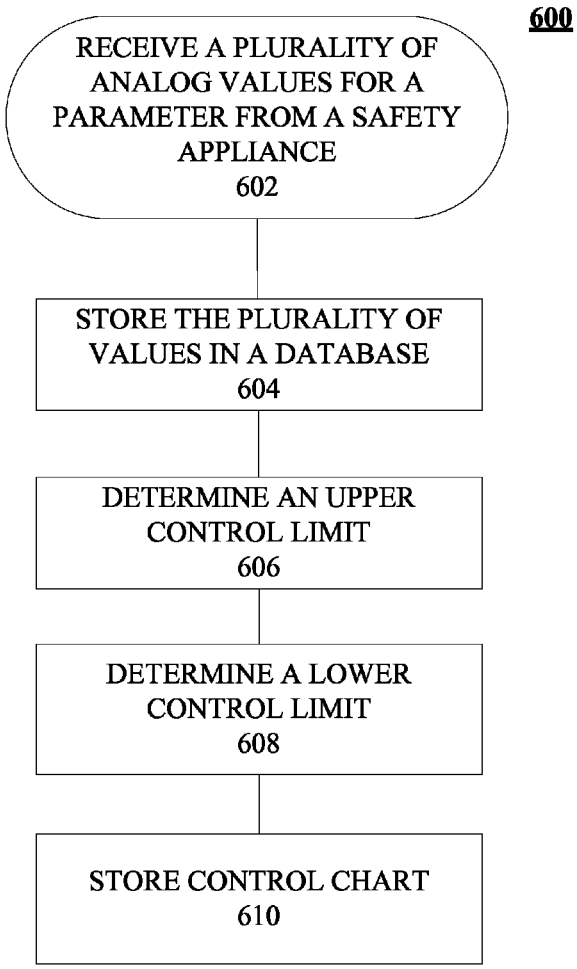
FIG. 6 depicts a second logic flow in accordance with one or more embodiments.

FIG. 6 illustrates a logic flow 600 in accordance with one or more embodiments. The logic flow 600 may be performed by various systems and/or devices and may be implemented as hardware, software, and/or any combination thereof, as desired for a given set of design parameters or performance constraints. Logic flow 600 may represent a process of generating a control chart, e.g. control chart 110, and may be executed, for example, by control chart generation component 320, or by monitoring device 110 generally.

Logic flow 600 may, in block 602, receive a plurality of analog values for a parameter from a safety appliance over a period of time. For example, monitoring device 112 may receive an analog value 340 from wired safety appliance 106 or wireless safety appliance 108 directly, or via ACP 104.

Logic flow 600 may, in block 604, store the plurality of analog values in a database. For example, control chart generation component 330 may store the values on storage medium 304. In some embodiments, the analog values may be stored only until the control chart is generated. In other embodiments, the analog values may be stored beyond generation of the control chart.

Logic flow 600 may, in block 606, determine an upper control limit. For example, control chart generation component 330 may analyze the analog values 340 and identify the highest value as the upper control limit 402. Other methods of calculating or determining an upper control limit may be used, for example, computing an average value from some number of the highest values; or determining an average value of all of the values, and setting the upper control limit as some fixed interval above the average.

Logic flow 600 may, in block 608, determine a lower control limit. Similarly to setting the upper control limit, a lower control limit 304 may be determined by control chart generation component 330 from the lowest value in the plurality of analog values 340, or other methods.

In some embodiments, control chart generation component 330 may be provided with some pre-populated expected values in order to speed up the generation of the control chart. Otherwise, control chart generation component 330 may delay determination of the upper and lower control limits, and the generation of the control chart, until a sufficient period of time or a statistically sufficient number of analog values has been collected.

Logic flow 600 may, at block 610, store the control chart. The control chart 110 may be stored with ACP 104, on monitoring device 112, or remotely from both ACP 104 and monitoring device 112, accessible over a network. Regardless of storage location, the stored control chart may be accessible to monitoring device 112.

In summary, the present embodiments improve the monitoring of safety appliances in a safety system and improve the detection of early signs of degradation and/or failure. This is advantageous both in cost savings of repairing smaller faults or conditions before an appliance has to be replaced, and in improving safety by addressing the smaller faults or conditions before the appliance fails to be able to alert to a safety problem.

Herein, novel and inventive apparatus and techniques for monitoring safety appliances in a safety system are disclosed. The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings.

Thus, such other embodiments and modifications are intended to fall within the scope of the present disclosure. Further, although the present disclosure has been described herein in the context of a particular implementation in a particular environment for a particular purpose, those of ordinary skill in the art will recognize that its usefulness is not limited thereto and that the present disclosure may be beneficially implemented in any number of environments for any number of purposes. Accordingly, the claims set forth below should be construed in view of the full breadth and spirit of the present disclosure as described herein.

What is claimed is:

1. A method for monitoring a safety appliance, comprising:
receiving an analog value for a parameter from the safety appliance at a monitoring device comprising a processing unit;
comparing the analog value to a control chart for the safety appliance at the monitoring device, the control chart including an upper control limit and a lower control limit for the parameter; and
issuing an alert when the comparison indicates an alert condition, wherein the alert condition is indicated when:
the analog value is larger or smaller than a mean value by a threshold value;
the analog value is larger than the upper control limit or smaller than the lower control limit;
a number of consecutively received analog values are more than a threshold amount outside of and on the same side of a mean value; or
a distance between a number of consecutively received analog values and a mean value is increasing.

2. The method of claim 1, wherein the parameter comprises at least one of: a voltage used by the safety appliance, a current drawn by the safety appliance, a temperature measured by the safety appliance, a temperature of the safety appliance, a percentage of a gas measured by the safety appliance, sounds detected by the safety appliance, motion detected by the safety appliance, and a percentage of obscurity measured by the safety appliance.

3. The method of claim 1, comprising:
receiving the analog value from an alarm control panel in communication with the safety appliance.

4. The method of claim 1, comprising:
receiving a plurality of analog values for the parameter from the safety appliance over a period of time;
recording the plurality of analog values in a database;
determining the control chart from the recorded analog values; and
storing the control chart in a data store.

5. The method of claim 1, wherein an alert is one or more of: an electronic mail message, a text message, a voicemail message, a visual alert, an audio alert, a graphical user interface alert component, and a telephone alert.

6. The method of claim 1, wherein the safety appliance and the monitoring device are co-located in a same building.

7. The method of claim 1, wherein the monitoring device is located remotely from a building where the safety appliance is operating.

8. An apparatus, comprising:
a processing unit;
a storage medium in communication with the processing unit storing:
a data comparison component executing on the processing unit to: receive an analog value for a parameter from a safety appliance, and compare the analog value to a control chart for the safety appliance, the control chart including an upper control limit and a lower control limit for the parameter; and
a notification component executing on the processing unit to issue an alert when:
the analog value is larger than the upper control limit or smaller than the lower control;

the analog value is larger or smaller than a mean value by a threshold value;

a number of consecutively received analog values are more than a threshold amount outside of and on the same side of a mean value; or a distance between a number of consecutively received analog values and a mean value is increasing.

9. The apparatus of claim 8, the storage medium further storing a control chart generation component to receive a plurality of analog values for the parameter from the safety appliance over a period of time; and determine the control chart from the recorded analog values.

10. The apparatus of claim 8, the storage medium further storing the control chart.

11. The apparatus of claim 8, wherein the parameter comprises at least one of: a voltage used by the safety appliance, a current drawn by the safety appliance, a temperature measured by the safety appliance, a temperature of the safety appliance, a percentage of a gas measured by the safety appliance, sounds detected by the safety appliance, motion detected by the safety appliance, and a percentage of obscurity measured by the safety appliance.

12. The apparatus of claim 8, the data comparison component operative to receive the analog value from an alarm control panel in communication with the safety appliance.

13. The apparatus of claim 8, the notification component operative to issue an alert comprising one or more of: an electronic mail message, a text message, a voicemail message, a visual alert, an audio alert, a graphical user interface alert component, and a telephone alert.

14. The apparatus of claim 8, wherein the safety appliance and the apparatus are co-located in a same building.

15. The apparatus of claim 8, wherein the apparatus is located remotely from a building where the safety appliance is operating.

16. A computer-readable storage medium comprising instructions, that when executed by a processing unit, causes a monitoring device to:

receive a plurality of analog values for a parameter from a safety appliance over a period of time;

record the plurality of analog values in a database;

determine a control chart from the recorded analog values including an upper control limit and a lower control limit for the parameter;

store the control chart in a data store;

receive an analog value for the parameter from the safety appliance;

compare the analog value to the control chart for the safety appliance; and issue an alert when the analog value is larger than the upper control limit or smaller than the lower control limit, the analog value is larger or smaller than a mean value by a threshold value, a number of consecutively received analog values are more than a threshold amount outside of, and on the same side of, a mean value, or a distance between a number of consecutively received analog values and a mean value is increasing.

17. The computer-readable storage medium of claim 16, further comprising instructions that when executed cause the monitoring device to: issue an alert when the analog value is larger or smaller than a normal value by a threshold value.

18. The computer-readable storage medium of claim 16, wherein the instructions to issue an alert comprising instructions to issue an alert comprising one or more of: an electronic mail message, a text message, a voicemail message, a visual alert, an audio alert, a graphical user interface alert component, and a telephone alert.

* * * * *